US005891826A

United States Patent [19]

Tsaur et al.

[11] Patent Number: 5,891,826

[45] Date of Patent: Apr. 6, 1999

[54] AFFIXING THERMAL DYE TRANSFER IMAGE ON MAGNET

[75] Inventors: Allen K. Tsaur, Rochester; Kin K. Lum, Webster; Teh-Ming Kung, Rochester, all of N.Y.

[73] Assignee: Eastman Kodak Company, Rochester, N.Y.

[21] Appl. No.: 979,515

[22] Filed: Nov. 26, 1997

[51] Int. Cl.[6] ..... B41M 5/035; B41M 5/38

[52] U.S. Cl. ..... 503/227; 156/235; 428/195; 428/480; 428/913; 428/914

[58] Field of Search ..... 8/471; 156/235; 428/195, 480, 913, 914; 503/227

[56] References Cited

FOREIGN PATENT DOCUMENTS 2907564 8/1980 Germany ..... 503/227

*Primary Examiner*—Bruce H. Hess

*Attorney, Agent, or Firm*—Harold E. Cole

[57] ABSTRACT

A method for affixing a thermal dye transfer image to a magnetic substrate comprising:

a) applying a heat-activatable adhesive on a release paper to a magnetic substrate;

b) peeling off the release paper;

c) imagewise heating a dye-donor element in face-to-face contact with an intermediate dye-receiving element comprising a dye-receiving layer which is weakly bonded to a substrate, thereby creating an image on the intermediate dye-receiving element;

d) laminating the imaged intermediate dye-receiving element in face-to-face contact with the heat-activatable adhesive layer on the magnetic substrate;

e) applying heat and/or pressure to the assemblage sufficient to activate the adhesive; and f) peeling off the weakly bonded support of the imaged intermediate dye-receiving element, thereby forming a thermal dye transfer image on the magnetic substrate.

4 Claims, No Drawings

AFFIXING THERMAL DYE TRANSFER IMAGE ON MAGNET

FIELD OF THE INVENTION

This invention relates to a new method of producing high image quality, thermal dye transfer images on a magnetic substrate.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

In recent years, magnets with images have been attached to various metallic surfaces, such as refrigerators, walls, etc. The images carried by these magnetic substrates may be produced in a variety of ways, such as photographically, or by thermal dye transfer printing or ink jet printing. The printed images are commonly attached to magnetic substrates by use of double-sided adhesive tape. However, there are problems with using tape in that it is difficult to securely affix the printed images to the magnetic substrate. The resulting assemblage tends to separate because the print may peel away from the magnet due to the effects of atmospheric moisture or exposure to elevated temperatures.

DESCRIPTION OF RELATED ART

DE 2,907,564 relates to a method for preparing magnetic advertising signs or magnetic white boards by applying to a resin- or rubber-bonded permanent magnet sheet, an intermediate layer and a dye-receiving layer for sublimation inks which are thermally transferred from a release paper carrying the dyes. However, there is a problem with this system in that the inefficiency of thermal dye transfer from a release paper to a dye-receiving element causes the image so produced to have a low dye density. The low density is caused by incomplete dye transfer from the release paper to the dye-receiving layer on the magnetic substrate.

It is an object of this invention to provide a method in which photograph-quality images can be securely and permanently affixed in a simple way to a variety of magnetic substrates.

SUMMARY OF THE INVENTION

These and other objects are achieved in accordance with this invention which relates to a method for affixing a thermal dye transfer image to a magnetic substrate comprising:

a) applying a heat-activatable adhesive on a release paper to a magnetic substrate;

b) peeling off the release paper;

c) imagewise heating a dye-donor element in face-to-face contact with an intermediate dye-receiving element comprising a dye-receiving layer which is weakly bonded to a substrate, thereby creating an image on the intermediate dye-receiving element;

d) laminating the imaged intermediate dye-receiving element in face-to-face contact with the heat-activatable adhesive layer on the magnetic substrate;

e) applying heat and/or pressure to the assemblage sufficient to activate the adhesive; and f) peeling off the weakly bonded support of the imaged intermediate dye-receiving element, thereby forming a thermal dye transfer image on the magnetic substrate.

DESCRIPTION OF THE PREFERRED EMBODIMENTS

If a special shape of magnet is desired, it can be pre-cut or cut off after the image has been printed on it. Also, the transferred thermal dye image may be a mirror image.

By use of the invention several advantages can be realized. There is no need for application of a separate dye-receiving layer since the heat-activatable adhesive on the magnet serves to hold onto the dye layer of the intermediate receiver element. Further, the applied image does not curl from the magnetic substrate and a high quality, personalized image can be obtained. Also, positioning an image on a magnetic surface is not a problem since a heat-activatable adhesive is used. Further, this invention can be extended to any type of image printed on a weakly-bonded dye-receiving intermediate element, including ink-jet printed images.

The polymers in the dye-receiving layer which may be employed for the intermediate receiver in a preferred embodiment are transparent. Such materials include polycarbonates, polyurethanes, polyesters, poly(vinyl chlorides), poly(styrene-co-acrylonitrile), polycaprolactone or any other receiver polymer or mixtures thereof. In a preferred embodiment, the dye image-receiving layer comprises a polycarbonate. Preferred polycarbonates include bisphenol-A polycarbonates having a number average molecular weight of at least about 25,000. Examples of such polycarbonates include General Electric LEXAN® Polycarbonate Resin, Bayer AG Makrolon 5700®, and the polycarbonates disclosed in U.S. Pat. No. 4,927,803, the disclosure of which is incorporated by reference.

The dye image-receiving layer employed in the intermediate receiver may be present in any amount which is effective for its intended purposes. In general, good results have been obtained at a receiver layer dry laydown of from about 1 to about 10 $g/m^2$, preferably from about 2 to about 5 $g/m^2$. Such a layer would have a thickness of from about 1 to about 10 $\mu$m.

The support for the intermediate receiver may be, for example, transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 $\mu$m to 1000 $\mu$m.

In the process of the invention, an intermediate receiver is employed wherein the dye image-receiving layer is weakly adhered to the support. The receiving layer needs to have enough adhesion to go through the printing process steps, yet have the ability to be delaminated easily at the final step of the process. This can be accomplished, for example, by using a subbing layer material such as an incompletely hydrolyzed silane coupling agent, or other materials which provide a weak bond.

A broad selection of polymeric resins can be utilized as heat-activatable adhesives in the invention, such as polyesters, polyester copolymers, polyamides, polyurethanes, polyolefins including ethylene vinyl acetate copolymers and ethylene acrylic acid polymers, hot melt materials, etc. Useful heat-activatable adhesives are also shown in U.S. Pat. No. 4,713,365 and U.S. Pat. No. RE 35,211. In a preferred embodiment of the invention, polyester or polyester copolymer adhesives are employed. In another preferred embodiment, the heat-activatable polyester or polyester copolymer adhesive is thermoplastic or thermally crosslinkable.

The heat-activatable adhesive is coated on a peelable support and can be easily released therefrom, such as by using a release paper or release liner, such as a waxy material, polyolefin coating, etc. Such materials are available commercially as HG Stablerite II by Avery Dennison Co., Painesville Ohio; 42# Easy Release Liner or 42# Tight Release Liner by Dunsirn Industries, Neenah, Wis.

Dye-donor elements that are used in the process of the invention conventionally comprise a support having thereon a dye-containing layer. Any dye can be used in the dye-donor element provided it is transferable to the dye-receiving layer by the action of heat. Especially good results have been obtained with sublimable dyes. Dye-donor elements applicable for use in the present invention are described, e.g., in U.S. Pat. Nos. 4,916,112; 4,927,803 and 5,023,228, the disclosures of which are hereby incorporated by reference.

As noted above, dye-donor elements are used to form a dye transfer image. Such a process comprises imagewise-heating a dye-donor element and transferring a dye image to a dye-receiving layer using the process as described above to form the dye transfer image.

The dye-donor element employed in the process of the invention may be used in sheet form or in a continuous roll or ribbon.

In a preferred embodiment of the invention, a dye-donor element is employed which comprises a poly(ethylene terephthalate) support coated with sequential repeating areas of cyan, magenta and yellow dye, and the above process steps are sequentially performed for each color to obtain a three-color dye transfer image. In another preferred embodiment, a clear protective layer is applied after the three colors noted above have been printed, as described in U.S. Pat. No. 5,387,573.

Thermal print heads which can be used to transfer dye from dye-donor elements to the ID card receiving elements of the invention are available commercially. There can be employed, for example, a Fujitsu Thermal Head (FTP-040 MCS001), a TDK Thermal Head F415 HH7-1089, Kyocera KBE-57-12MGL2 Thermal Print Head or a Rohm Thermal Head KE 2008-F3. Alternatively, other known sources of energy for thermal dye transfer may be used, such as lasers as described in, for example, GB No. 2,083,726A.

The following examples are provided to further illustrate the invention.

EXAMPLES

Example 1

Preparation of Thermal Dye Transfer Receiving Elements with an Incompletely Hydrolyzed Subbing Layer The thermal dye transfer receiving elements in this example are composed of the following functional layers:

(1) microvoided receiver support (2) an incompletely hydrolyzed subbing layer (3) dye-receiving layer (4) receiver overcoat/topcoat The detailed solution preparation and coating procedure of the dye-receiving elements are shown below:

The microvoided receiver support samples were prepared in the following manner: commercially available packaging films (OPPalyte 350 K18® and BICOR 70 MLT® made by Mobil Chemical Co.) were laminated to the paper stock described below. OPPalyte 350 K18® is a composite film (36 $\mu$m thick) (d=0.62 g/cm$^3$) consisting of a microvoided and orientated polypropylene core (approximately 73% of the total film thickness), with a titanium dioxide pigmented non-microvoided orientated polypropylene layer on each side; the void-initiating material is poly(butylene terephthalate). BICOR 70 MLT® is an orientated polypropylene film (18 $\mu$m thick). Reference is made to U.S. Pat. No. 5,244,861 where details for the production of this laminate are described.

Packaging films may be laminated in a variety of ways (by extrusion, pressure, or other means) to a paper support. In the present context, they were extrusion laminated as described below with pigmented polyolefin on the front side and clear polyolefin on the backside of the paper stock support. The OPPalyte 350 K18® film was laminated on the front side and the 70 MLT film was laminated on the backside. The pigmented polyolefin (12 g/m$^2$) contained anatase titanium dioxide (12.5% by weight) and a benzoxazole optical brightener (0.05% by weight). The clear polyolefm was high density polyethylene (12 g/m$^2$).

The paper stock was 137 $\mu$m thick and made from a 1:1 blend of Pontiac Maple 51® (a bleached maple hardwood kraft of 0.5 $\mu$m length weighted average fiber length) available from Consolidated Pontiac, Inc., and Alpha Hardwood Sulfite® (a bleached red-alder hardwood sulfite of 0.69 $\mu$m average fiber length), available from Weyerhauser Paper Co.

A subbing layer coating solution was prepared by mixing Prosil 221® 3-aminopropyl triethoxysilane (PCR Inc.) with Prosil 2210®, a hydrophobic epoxy-terminated organooxysilane (PCR Inc.) at a 1:1 weight ratio in an ethanol-methanol solvent mixture. The resultant test solutions contained approximately 1% of silane component and 99% of anhydrous 3A alcohol. The test solution was not kept for more than six hours before it was coated onto the above receiver support, so that it was not completely hydrolyzed. Prior to coating, the support was subjected to a corona discharge treatment of approximately 450 joules/m$^2$.

The subbing layer test sample was overcoated with a dye-receiving layer containing Makrolon KL3-1013® polyether-modified bisphenol-A polycarbonate block copolymer (Bayer AG) (1.742 g/m$^2$), Lexan 141-112® bisphenol-A polycarbonate (General Electric Co.) (1.426 g/m$^2$), Fluorad FC-431-112® perfluorinated alkyl sulfonamidoalkyl ester surfactant (3M Co.) (0.011 g/m$^2$), and Drapex 429® polyester plasticizer (Witco Corp.) (0.264 g/m$^2$), and diphenyl phthalate (0.528 g/m$^2$) coated from methylene chloride.

The dye-receiving layer was then overcoated with a solvent mixture of methylene chloride and trichloroethylene; a polycarbonate random terpolymer of bisphenol-A (50 mole-%), diethylene glycol (49 mole-%), and polydimethylsiloxane (1 mole-%) (2,500 MW) block units (0.550 g/m$^2$); a bisphenol A polycarbonate modified with 50 mole-% diethylene glycol (2,000 MW) (0.11 g/m$^2$); Fluorad FC-431® surfactant (0.022 g/m$^2$); and DC-510® surfactant (Dow Coming Corp.) (0.003 g/m$^2$).

Preparation of Reversed (or Mirror) Thermal Dye Transfer Image Print

The above prepared multilayer dye-receiver element was then subjected to thermal dye transfer printing. A digitally reversed individual image was printed in a Kodak XLS 8650® Thermal Printer using a commercially available Kodak EKTATHERM® XLS Extralife donor ribbon. This ribbon had repeating patches of yellow, magenta and cyan dye layers and a clear protective layer. The reversed image was formed and contained within the above dye-receiving layer and receiver overcoat/topcoat.

Heat-Activatable Film Adhesive On Release Liner

A commercially-available, crystalline polyester, heat-activatable film adhesive of Bostik 10-300-2/3® (Bostik Co.) was used at a dry thickness of between 50.8 and 76.2 μm. This material is a thermally crosslinkable polyester which was already coated on a release liner.

Assembly Procedure

Step 1

A 5.08 cm×5.08 cm vinyl magnet was obtained from CD Tees, Dover, Ohio. The magnet was placed against the above heat-activatable Bostik 10-300-2/3 film with the adhesive side facing the magnet. This assemblage was then placed inside a paper-based carrier with its release coating side directly contacting the assemblage. The carrier with said assemblage was fed at a linear speed of 8.9 cm/s through a Datacode Systems Laminator® (Model-Pouch 4") at a set temperature of 154° C. The assemblage was then removed from the carrier. The heat-activatable adhesive layer stuck firmly to this magnet after running through the laminator at the stated temperature and speed (0.5 s total time for the magnet going through the heating region). The release paper support was easily separated from the adhesive layer.

Step 2

The magnet with the heat-activatable film adhesive prepared in Step 1 above was placed against the thermal dye transfer image print with the film adhesive facing the image side. This assemblage was placed inside a paper-based carrier with its release coating side directly contacting the assemblage. The carrier with the assemblage was fed at a linear speed of 8.9 cm/s through a Datacode Systems Laminator (Model-Pouch 4") at a set temperature of 154° C. The assemblage was then removed from the carrier. After the laminator treatment, the thermal dye transfer image adhered firmly to the film adhesive. The microvoided receiver support was then easily separated from the image-containing layer, i.e., the dye-receiving layer and receiver overcoat/topcoat, due to the weakly bonded subbing layer. After removing the microvoided receiver support, a thin thermal dye transfer image was obtained on the magnet.

Example 2

Example 1 was repeated except that the adhesive was Bostik 7962® (Bostik Co.) which was used at a final dry laydown of approximately 1.65 g/m$^2$. The adhesive was dissolved in methylene chloride. The solution which contained approximately 9.1% by weight Bostik 7962® was then coated on a release liner, HG Stablerite II by Avery Dennison Co., Painesville Ohio, by a doctor blade. Similar results were obtained.

The invention has been described in detail with particular reference to preferred embodiments thereof, but it will be understood that variations and modifications can be effected within the spirit and scope of the invention.

What is claimed is:

1. A method for affixing a thermal dye transfer image to a magnetic substrate comprising:

a) applying a heat-activatable adhesive on a release paper to a magnetic substrate;

b) peeling off said release paper;

c) imagewise heating a dye-donor element in face-to-face contact with an intermediate dye-receiving element comprising a dye-receiving layer which is weakly bonded to a substrate, thereby creating an image on said intermediate dye-receiving element;

d) laminating said imaged intermediate dye-receiving element in face-to-face contact with said heat-activatable adhesive layer on said magnetic substrate;

e) applying heat and/or pressure to said assemblage sufficient to activate said adhesive; and f) peeling off said weakly bonded support of said imaged intermediate dye-receiving element, thereby forming a thermal dye transfer image on said magnetic substrate.

2. The process of claim 1 wherein said dye-receiving layer is transparent.

3. The process of claim 1 wherein said heat-activatable adhesive is a polyester or polyester copolymer.

4. The process of claim 3 wherein said heat-activatable polyester or polyester copolymer adhesive is thermoplastic or thermally crosslinkable.

* * * * *